US006978890B2

(12) United States Patent
Pangerc et al.

(10) Patent No.: US 6,978,890 B2
(45) Date of Patent: Dec. 27, 2005

(54) SCREWDRIVER BIT PACKAGE

(75) Inventors: James E. Pangerc, Baltimore, MD (US); Robert P. Welsh, Hunt Valley, MD (US); William Bredlow, Bel Air, MD (US); Carlo Massobrio, Fort Gratiot, MI (US)

(73) Assignee: Black & Decker Inc., Newark, DE (US)

( * ) Notice: Subject to any disclaimer, the term of this patent is extended or adjusted under 35 U.S.C. 154(b) by 15 days.

(21) Appl. No.: 10/458,134

(22) Filed: Jun. 10, 2003

(65) Prior Publication Data

US 2004/0256265 A1 Dec. 23, 2004

(51) Int. Cl.[7] ..... B65D 85/24

(52) U.S. Cl. ..... 206/349; 206/377; 206/379; 220/500

(58) Field of Search ..... 206/349, 372, 206/373, 377, 379; 220/500

(56) References Cited

U.S. PATENT DOCUMENTS 5,951,385 A * 9/1999 Newhouse et al. ..... 451/358
6,547,074 B1 * 4/2003 Chen ..... 206/379

FOREIGN PATENT DOCUMENTS

| | | |
|---|---|---|
| DE | 92 05 913 | 8/1993 |
| DE | 94 19 983 | 3/1995 |
| EP | 0 313 733 | 5/1989 |
| EP | 0 476 343 | 3/1992 |
| EP | 0 876 884 | 11/1998 |

OTHER PUBLICATIONS

European Search Report dated Aug. 24, 2004.

* cited by examiner

*Primary Examiner*—Jim Foster
(74) *Attorney, Agent, or Firm*—Harness, Dickey & Pierce, P.L.C.

(57) ABSTRACT

A tool container has a first and second housing as well as a tool retainer. The first and second housings are rotatably coupled with the tool retainer. The first and second housings move from a closed position, surrounding the tool retainer prohibiting access to the tool retainer, to an open position, enabling access to the tool retainer. The tool retainer is independently rotatable with respect to the first and second housings in the open position. The tool retainer has at least one member to retain a tool on the tool retainer. The tool retainer has a compartment which is accessible when the first and second housings are in both said open and closed positions.

13 Claims, 3 Drawing Sheets

SCREWDRIVER BIT PACKAGE

BACKGROUND OF THE INVENTION

The present invention relates to tool containers and, more particularly, to a container for tools such as screwdriver bits, drill bits, or the like.

Various types of containers exist which carry screwdriver bits. Several of the containers have various types of retention mechanism to retain the tool bits in the container. Some of the containers are opened to enable the user direct access to the tool bits. However, some of the containers enclose the bit holder so that they must be opened in order to enable access to the tool bits. In these cases, sometimes the bit holders are stationary with the bits secured in the bit holder.

Also, some of these containers include a device for carrying an extension bit or the like. The extension bit of the like may be secured directly to the container or may be placed into a retainer. While these tool containers appear to work satisfactorily for their intended purposes, designers strive to improve the art.

SUMMARY OF THE INVENTION

The present invention provides a compact tool container to carry a plurality of tool bits. The container includes a clam shell housing which moves from a closed to an open position to enable access to the bits. Also, the tool holder is rotatable independently of the housing so that, in an open position, the tool holder can be rotated. Also, the tool bit container includes a compartment which may be accessed when the container is in the open or closed position.

According to aspects of the present invention, a tool container comprises a first and second housing. A tool retainer is movably coupled with the first and second housings. The first and second housing move from a closed position, surrounding the tool retainer prohibiting access to the tool retainer, to an open position, enabling access to the tool retainer. The tool retainer is independently rotatable with respect to the first and second housing in the open position. The tool retainer has at least one member to retain a tool bit on the tool retainer. The tool retainer has a compartment which is accessible when the first and second housing are in both the open and closed position. A movable door covers the compartment. The tool retainer includes a pivot. The first and second housings include openings which couple with the pivot to enable rotation. The compartment is formed by a bore through the pivot. The tool retainer includes a slot to receive a tool bit holder. The tool bit holder includes the at least one member to retain a tool and is manufactured from a thermal plastic material. Each member for retaining a tool includes a circumferential wall defining a bore with at least one projection extending radially inward to contact a tool bit to be retained in the bore. Preferably, there are four projections which extend axially along the circumferential wall. The first and second housings open with respect to one another so that an angle is formed between the two of up to 190°. The first and second housings may be transparent enabling viewing of the tool bits inside the container. The tool retainer is pivotable along an arc from about 0 to about 45° with respect to the housings. Also, a latch is included to lock the first and second housings in the closed position.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
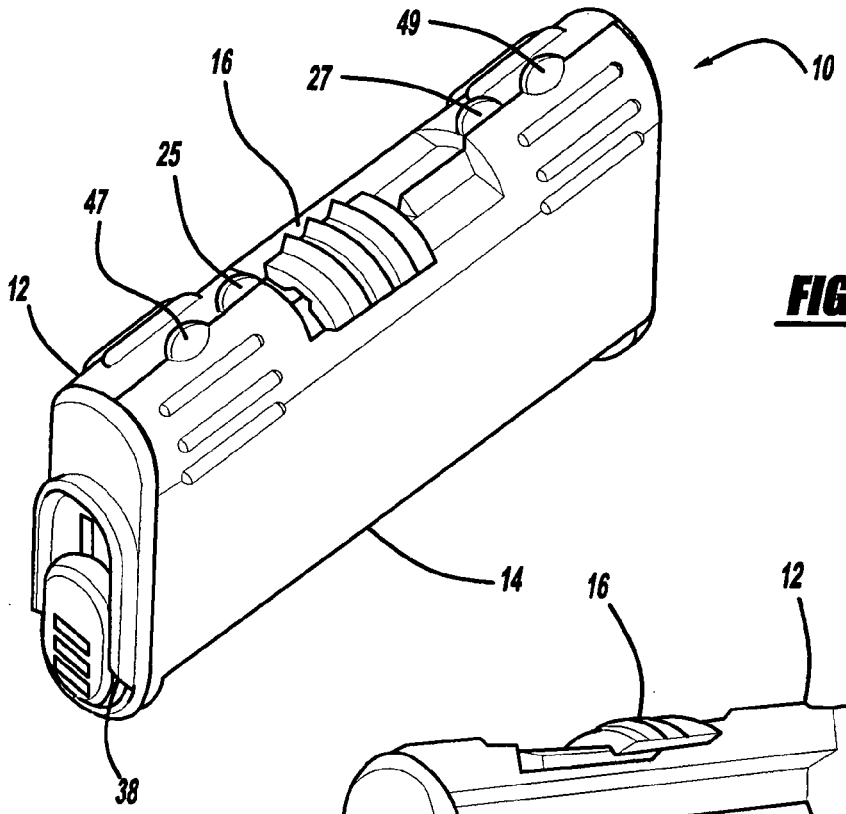
FIG. 1 is a perspective view of a tool container in accordance with the present invention in a closed position.
Figure 2:
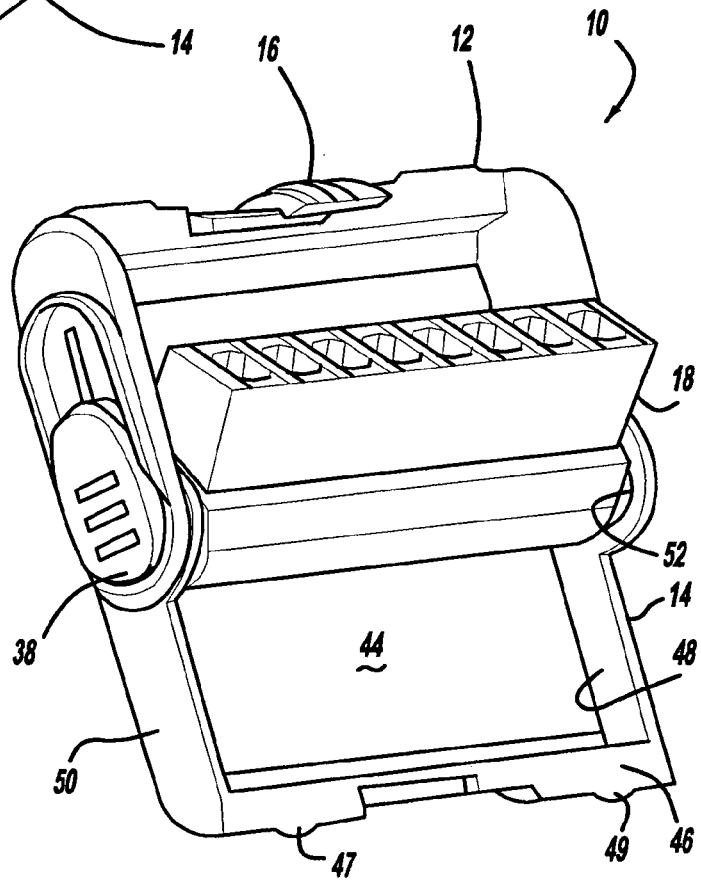
FIG. 2 is a perspective view of the tool container in FIG. 1 in an opened position.
Figure 3:
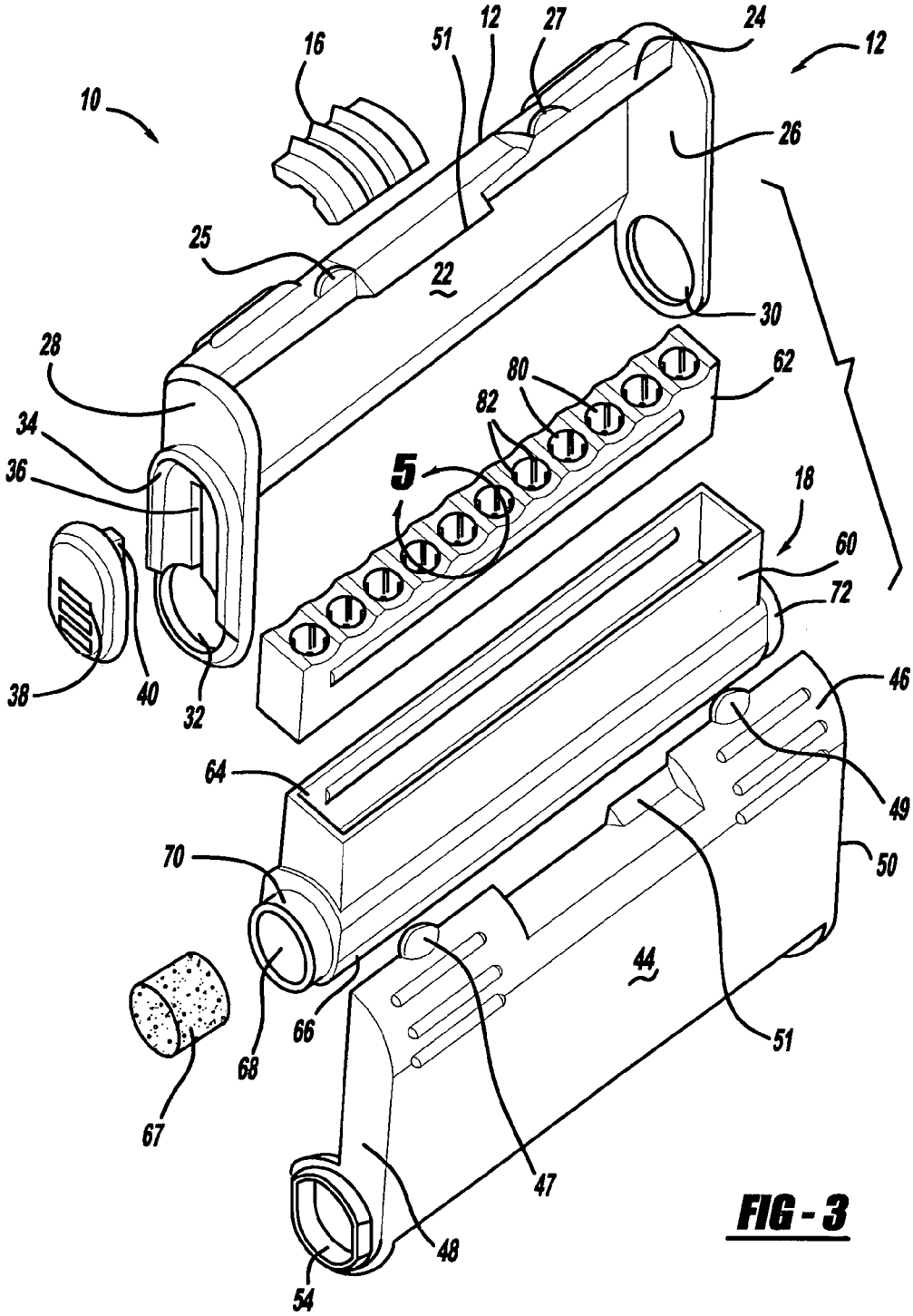
FIG. 3 is an exploded perspective view of the tool container in accordance with the present invention.

Turning to FIGS. 1 and 2, a tool container is shown and designated with the reference numeral 10. The tool container includes a first housing 12 and a second housing 14. The housings 12 and 14 may be transparent enabling viewing inside of the tool container. In FIG. 1, the containers are shown in a closed position wherein a latch 16 locks the housings 12 and 14 together. A tool bit retainer 18 is positioned inside of the housings 12 and 14.

The housing 12 includes a base 22 which includes a continuous curved wall 24. Curved wall 24 includes offset portions 25 and 27 which enhance opening of the housings 12 and 14. Sidewalls 26 and 28 extend from the base and are continuous with the curved wall 24. The sidewalls 26 and 28 at their free ends include apertures 30 and 32 which secure to the tool holder 18. The sidewall 28 includes a flange 34 surrounding a slot 36. A door 38 with a projection 40, which fits into slot 36, slides within the flange 34. The door 38 is slidable inside the flange to cover a compartment which will be explained later.

The housing 14 includes a base 44 with a curved wall 46 and sidewalls 48 and 50. Curved wall 46 includes offset portions 47 and 49 which enhance opening of the housings 12 and 14. The sidewalls 48 and 50 include apertures 52 and 54 which enable rotation of the housing 14. The curved wall 46, like curved wall 24, includes a rail portion 51 for receiving the latch 16 to lock the housing members together.

The tool bit retainer 18 includes a housing portion 60 and a bit receiving portion 62. The housing 60 includes a slot 64 to receive the bit holding portion 62. Also, the housing portion 60 includes an unitarily formed tube portion 66. The tube portion 66 includes a bore 68 which may receive a tool holder or the like and include a foam plug 67 to prohibit vibration. Flanges 70 and 72 form a pivot so that the openings on the housings 12 and 14 may fit around the flanges 70 and 72 to enable rotation of the housings as well as the tool retainer 18 with respect to one another. The bore 68 is covered by the door 38. The door 38 may be opened and closed to expose the bore 68 when the housings are in a closed as well as an opened position. Thus, the bore 68 may be accessed at any time. Also, the bore may include a dampening member, such as a foam plug, to prevent rattling noise from a bit holder.

The tool bit holder 62 has an overall rectangular configuration. The tool bit holder 62 is formed from a thermal plastic material. Thus, the tool holder 62 is elastic and may be compressed. The tool holder 62 includes a plurality of bore members 80 to receive tool bits. The tool bit holder 62 fits into slot 64 of the bit retainer 18 to retain the tool bit holder 62 in the tool bit retainer 18. Each of the plurality of bores 80 includes at least one, preferably four, projecting members 82. The projecting members 82 extend radially inward from the circumference of the bore 80. Also, the members 82 extend axially along the bore. The members 82 are unitarily formed with the tool bit holder 62.

As a tool bit is inserted into the bore 80, it contacts the projecting members 82. The projecting members 82 compress to enable further insertion of the tool bit into the bore 80. Due to the elastomeric resilience of the material that makes up the projecting members 82, the projecting members 82 exert a counter force onto the tool bit to retain the tool within the bit holder 62. The bores 80 may be identical to retain identical bits. Also, the bores may have varying sizes to retain different sizes of tool bits such as drill bits. Further, indicia may be positioned onto the tool holder or bit retainer 18 to identify to the user which tool bit is in the specific bore 80.

During assembly of the unit, the apertures 30 and 32, as well as 52 and 54 of the housing members 12 and 14, respectively, are positioned onto the flanges 70 and 72 which form the pivot of the bit retainer 18. Due to this type of connection, the housings 12 and 14 move independently of one another as well as with respect to one another. Likewise, the bit retainer 18 may be moved independently of the housing members 12 and 14. Thus, the bit retainer 18 may be moved from a first position, where it is inside of housing 12, to a second position angled with respect to housing 12. Ordinarily, the bit retainer 18 can be moved to approximately a 45° angle with respect to the housing 12. This allows ready access to the tool bits within the bit retainer.

Figure 4:
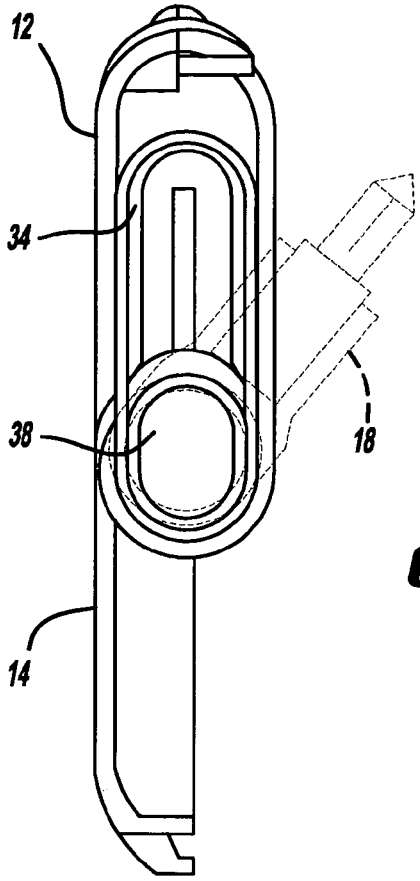
FIG. 4 is a side elevational view of the tool container of FIG. 2
Figure 5:
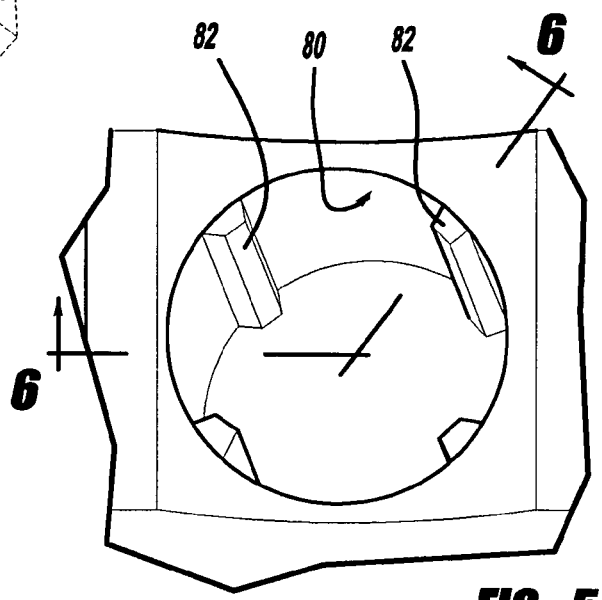
FIG. 5 is an enlarged perspective view of the tool holder.
Figure 6:
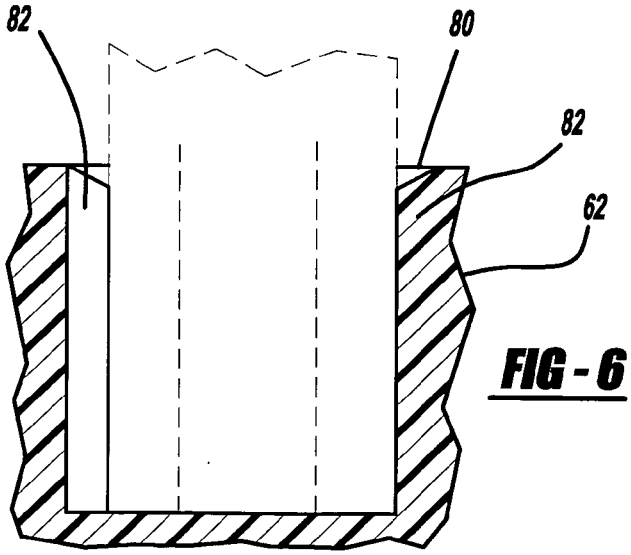
FIG. 6 is a cross-sectional view along line 6—6 of FIG. 5.

Also, the housing members 12 and 14 open with respect to one another along an angle up to 190° as shown in FIG. 4. Stops can be formed along the hoops defining the apertures 30, 32, 52, 54 to contact one another to determine the angle of opening between the two housing members. Likewise, a stop could be mounted on the flanges 70 and 72 to stop movement of the tool retainer 18 with respect to the housings 12 and 14.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A tool container comprising:

a first housing and a second housing;

a tool retainer, said tool retainer having at least one member for retaining a tool on said tool retainer, said first and second housings rotatably coupled with said tool retainer, said first and second housings moving from a closed position surrounding said tool retainer prohibiting access to said at least one member of said tool retainer to an open position enabling access to said at least one member of said tool retainer;

said tool retainer being independently rotatable about an axis with respect to said first and second housings in said open position;

said tool retainer having a compartment which is accessible along an intersection of said axis and an external surface of said tool retainer when said first and second housing are in both said open and closed positions.

2. The tool container according to claim 1, wherein a movable door covers said compartment.

3. The tool container according to claim 1, wherein said tool retainer includes a pivot and said first and second housings include openings coupling with said pivot for enabling rotation.

4. The tool container according to claim 3, wherein said compartment is formed by a bore through said pivot.

5. The tool container of claim 1, wherein said tool retainer includes a slot for receiving a tool holder.

6. The tool container of claim 5 wherein said tool holder includes said at least one member for retaining a tool.

7. The tool container of claim 6 wherein said tool holder is manufactured from a thermoplastic.

8. The tool container of claim 7 wherein each member for retaining a tool includes a circumferential wall defining a bore and at least one projection extending radially inwardly for contacting a tool bit to retain the tool bit in said bore.

9. The tool container of claim 8 wherein said circumferential wall has four projections.

10. The tool container of claim 1, wherein said first and second housings in said open position form an angle with respect to one another up to about 190° and said tool retainer is pivotable along an angle from about 0° to about 45° with respect to said first housing.

11. The tool container of claim 8 wherein said at least one projecting member extends axially along said circumferential wall.

12. The tool container of claim 1, wherein a latch locks said first and second housings in said closed position.

13. A tool container comprising:

a first housing and a second housing;

a tool retainer, said tool retainer having at least one member for retaining a tool on said tool retainer, said first and second housings rotatably coupled with said tool retainer, said first and second housings moving from a closed position surrounding said tool retainer prohibiting access to said at least one member of said tool retainer to an open position enabling access to said at least one member of said tool retainer;

said tool retainer having a compartment which is accessible when said first and second housing are in both said open and closed positions; and a movable door covering said compartment such that the door moves between a first position covering said compartment to a second position enabling access to said compartment.

* * * * *